US006519782B2

(12) United States Patent
Collins et al.

(10) Patent No.: US 6,519,782 B2
(45) Date of Patent: Feb. 18, 2003

(54) BASEBALL CATCHER'S CHEST PROTECTOR

(75) Inventors: Gregory James Collins, Loretto (CA); Kenneth W. Nimmons, Litchfield, IL (US)

(73) Assignee: HOS Development Corporation, Litchfield, IL (US)

( * ) Notice: Subject to any disclaimer, the term of this patent is extended or adjusted under 35 U.S.C. 154(b) by 0 days.

(21) Appl. No.: 09/846,887

(22) Filed: May 1, 2001

(65) Prior Publication Data

US 2002/0162162 A1 Nov. 7, 2002

(51) Int. Cl.[7] ..... A41D 13/00
(52) U.S. Cl. ..... 2/463
(58) Field of Search ..... 2/455, 108, 267, 2/456–459, 69, 69.5, 2.5, 81, 85, 92–94, 102, 16, 22, 461–467, 247–250, 913, DIG. 1, 44, 45

(56) References Cited

U.S. PATENT DOCUMENTS

| | | | | |
|---|---|---|---|---|
| 476,503 | A | | 6/1892 | Woodward |
| 817,656 | A | | 4/1906 | McCalla |
| 833,546 | A | | 10/1906 | Pierce |
| 925,851 | A | | 6/1909 | Sullivan |
| 932,352 | A | | 8/1909 | Sullivan |
| 1,670,239 | A | | 5/1928 | Cline |
| 1,970,130 | A | | 8/1934 | Dickenson |
| 2,001,508 | A | | 5/1935 | Tobin |
| 2,437,054 | A | | 3/1948 | Tatai |
| 2,438,072 | A | | 3/1948 | Piccinni |
| 2,440,664 | A | | 4/1948 | Irons |
| 2,471,071 | A | | 5/1949 | McDonald |
| 2,553,612 | A | | 5/1951 | Taylor |
| 2,786,209 | A | | 3/1957 | Kleinman |
| 2,976,539 | A | | 3/1961 | Brown, Jr. |
| 3,076,197 | A | | 2/1963 | Glahe |
| 3,125,762 | A | | 3/1964 | Glahe |
| 3,135,961 | A | | 6/1964 | Roderick |
| 3,208,080 | A | | 9/1965 | Hirsch |
| 3,248,738 | A | | 5/1966 | Morgan |
| 3,348,236 | A | | 10/1967 | Copeland |
| 3,514,786 | A | | 6/1970 | Terwilliger |
| 3,574,861 | A | | 4/1971 | Hale |
| 3,866,909 | A | | 2/1975 | DeSantis |
| 3,945,042 | A | | 3/1976 | Lobo |
| 4,213,202 | A | | 7/1980 | Larry |
| 4,272,847 | A | * | 6/1981 | Buhler ..... 2/461 |
| 4,292,263 | A | | 9/1981 | Hanrahan et al. |
| 4,307,471 | A | | 12/1981 | Lovell |
| 4,322,858 | A | | 4/1982 | Douglas |
| 4,325,148 | A | | 4/1982 | Livernois |
| 4,373,211 | A | | 2/1983 | Goudreau et al. |
| 4,413,357 | A | | 11/1983 | Sacks |

(List continued on next page.)

FOREIGN PATENT DOCUMENTS

| | | |
|---|---|---|
| DE | 34 01 111 | 7/1985 |
| FR | 812317 | 5/1937 |
| FR | 861120 | 2/1941 |

OTHER PUBLICATIONS

Schutt Sports Catalog, published by Schutt Sports, Aug., 1999, pp. 1–105.

*Primary Examiner*—John J. Calvert
*Assistant Examiner*—Tejash Patel
(74) *Attorney, Agent, or Firm*—Brinks Hofer Gilson & Lione

(57) ABSTRACT

A chest protector that includes a pouch assembly having an interior in communication with an opening, the pouch assembly having a hole in fluid communication with the interior and ambient air and a pad inserted into the interior, wherein the pad includes an opening that is in fluid communication with the hole of the pouch assembly.

22 Claims, 4 Drawing Sheets

U.S. PATENT DOCUMENTS 4,422,183 A * 12/1983 Landi et al. ..... 2/455
4,441,211 A 4/1984 Donzis
4,453,271 A 6/1984 Donzis
4,507,801 A 4/1985 Kavanagh et al.
4,507,802 A 4/1985 Small
4,525,875 A 7/1985 Tomczak
4,538,301 A 9/1985 Sawatzki et al.
4,580,408 A * 4/1986 Stuebner ..... 62/259.3
4,599,747 A 7/1986 Robinson
D287,181 S 12/1986 Parsons, Jr.
4,642,814 A 2/1987 Godfrey
4,677,698 A 7/1987 Angas
4,680,813 A 7/1987 Glaesner
4,685,155 A 8/1987 Fingerhut et al.
4,688,269 A 8/1987 Maeshima
4,697,285 A 10/1987 Sylvester
4,700,407 A 10/1987 Mattila
4,788,972 A 12/1988 DeBusk
4,810,559 A 3/1989 Fortier et al.
4,825,476 A 5/1989 Andrews
4,829,992 A 5/1989 Cilladi et al.
4,847,913 A 7/1989 Chen
4,870,706 A 10/1989 Ketcham et al.
4,872,215 A 10/1989 Sliger
4,884,295 A 12/1989 Cox
4,926,503 A 5/1990 Wingo, Jr.
4,982,447 A 1/1991 Henson
4,993,076 A * 2/1991 Dierickx ..... 2/2.5
4,996,720 A * 3/1991 Fair ..... 2/44
5,007,108 A 4/1991 Laberge et al.
5,020,156 A 6/1991 Neuhalfen
5,052,052 A 10/1991 Gilford et al.
5,146,621 A 9/1992 Hadar et al.
5,168,576 A * 12/1992 Krent et al. ..... 2/16
5,187,812 A 2/1993 Neuhalfen
5,274,846 A 1/1994 Kolsky
5,325,538 A 7/1994 Schoenweiss et al.
5,375,262 A 12/1994 Carter
5,398,340 A 3/1995 Kibbee
5,423,087 A 6/1995 Krent et al.
5,524,641 A 6/1996 Battaglia
5,530,966 A 7/1996 West
5,605,144 A 2/1997 Simmons et al.
5,652,967 A * 8/1997 Hsu ..... 2/455
5,742,947 A 4/1998 Davis
5,790,981 A 8/1998 Bzoch
5,918,309 A 7/1999 Bachner, Jr.
6,035,452 A * 3/2000 Braxton ..... 2/16
6,035,453 A 3/2000 Cain
D426,031 S 5/2000 Flandez
6,182,299 B1 * 2/2001 Chen ..... 2/463

* cited by examiner

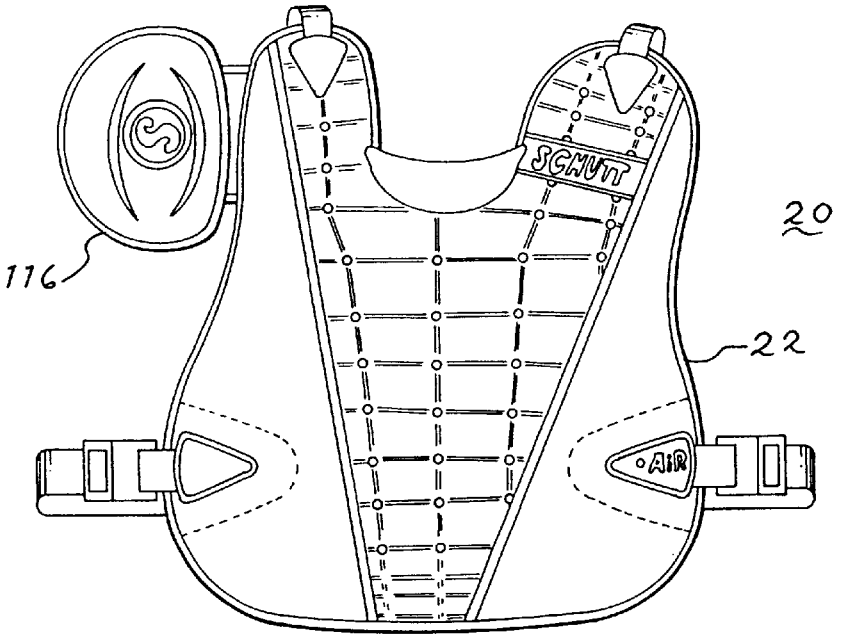
Fig. 1
Fig. 5
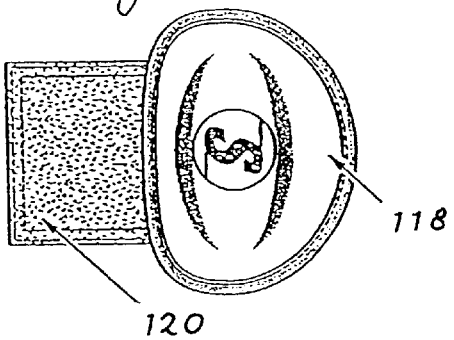
Fig. 6
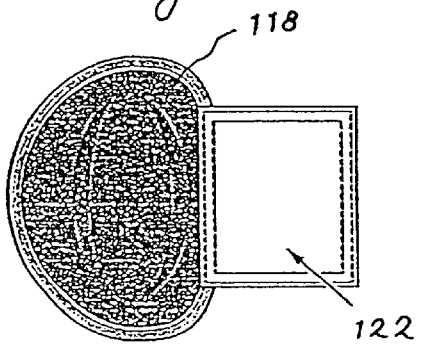
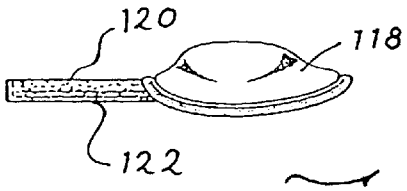
Fig. 7

106
108
104
110
112
113
114

BASEBALL CATCHER'S CHEST PROTECTOR

BACKGROUND OF THE INVENTION

1. Field of the Invention

This invention relates to chest protectors for wearing during sports play and more particularly to chest protectors worn by catchers during the play of baseball or softball.

2. Discussion of Related Art

A chest protector is commonly used and is required for league play in baseball and softball, as a hard thrown baseball pitch or bat deflected ball striking a catcher's unprotected chest or shoulder may cause severe injury. Besides providing protection, the chest protector is often used to intentionally block balls thrown in the dirt so that the ball is directed in front of the catcher so that the catcher can easily retrieve the ball and prevent a runner from stealing a base.

As is well known, the catcher wears a number of protective gear besides a chest protector. For example, a catcher will ordinarily wear two shin guards and a catcher's mask. This additional equipment in conjunction with the chest protector can cause the catcher to become uncomfortable from the heat and sweat generated by the equipment during the playing of a game in the middle of summer.

Another disadvantage of chest protectors is that they get dirty from the dirt of the playing field and the sweat of the catcher. Past chest protectors made their cleaning cumbersome in that the whole chest protector, including the straps, would need to be thrown into the washer.

SUMMARY OF THE INVENTION

One aspect of the present invention regards a chest protector that includes a pouch assembly having an interior in communication with an opening, the pouch assembly having a hole in fluid communication with the interior and ambient air and a pad inserted into the interior, wherein the pad includes an opening that is in fluid communication with the hole of the pouch assembly.

A second aspect of the present invention regards a method of using a chest protector that includes inserting a pad into an interior of a pouch assembly, having a person wear the pouch assembly and the inserted pad and having ambient air freely flow through a first surface of the pouch assembly, through the pad, and contacting a surface of the person wearing the pouch assembly and the inserted pad.

A third aspect of the present invention regards a method of using a chest protector that includes inserting a pad into an interior of a pouch assembly, having a person wear the pouch assembly and inserted pad during the playing of baseball or softball and removing the pad from the interior of the pouch assembly.

Each aspect of the present invention provides the advantage of providing a chest protector that lessens the amount of heat that a player is subjected to during the play of a game.

Each aspect of the present invention provides a second advantage in that it provides a chest protector that is easy to clean.

The foregoing features and advantages of the present invention will be further understood upon consideration of the following detailed description of the invention taken in conjunction with the accompanying drawings, in which:

BRIEF DESCRIPTION OF THE DRAWINGS

FIG. 1 shows a front view of a first embodiment of a chest protector according to the present invention;

FIG. 5 shows a top view of a shoulder cap to be used with the chest protector of FIG. 1;

FIG. 6 shows a bottom view of the shoulder cap of FIG. 5; and

FIG. 7 shows a side view of the shoulder cap of FIG. 5.

DESCRIPTION OF THE PREFERRED EMBODIMENT

Figure 2:
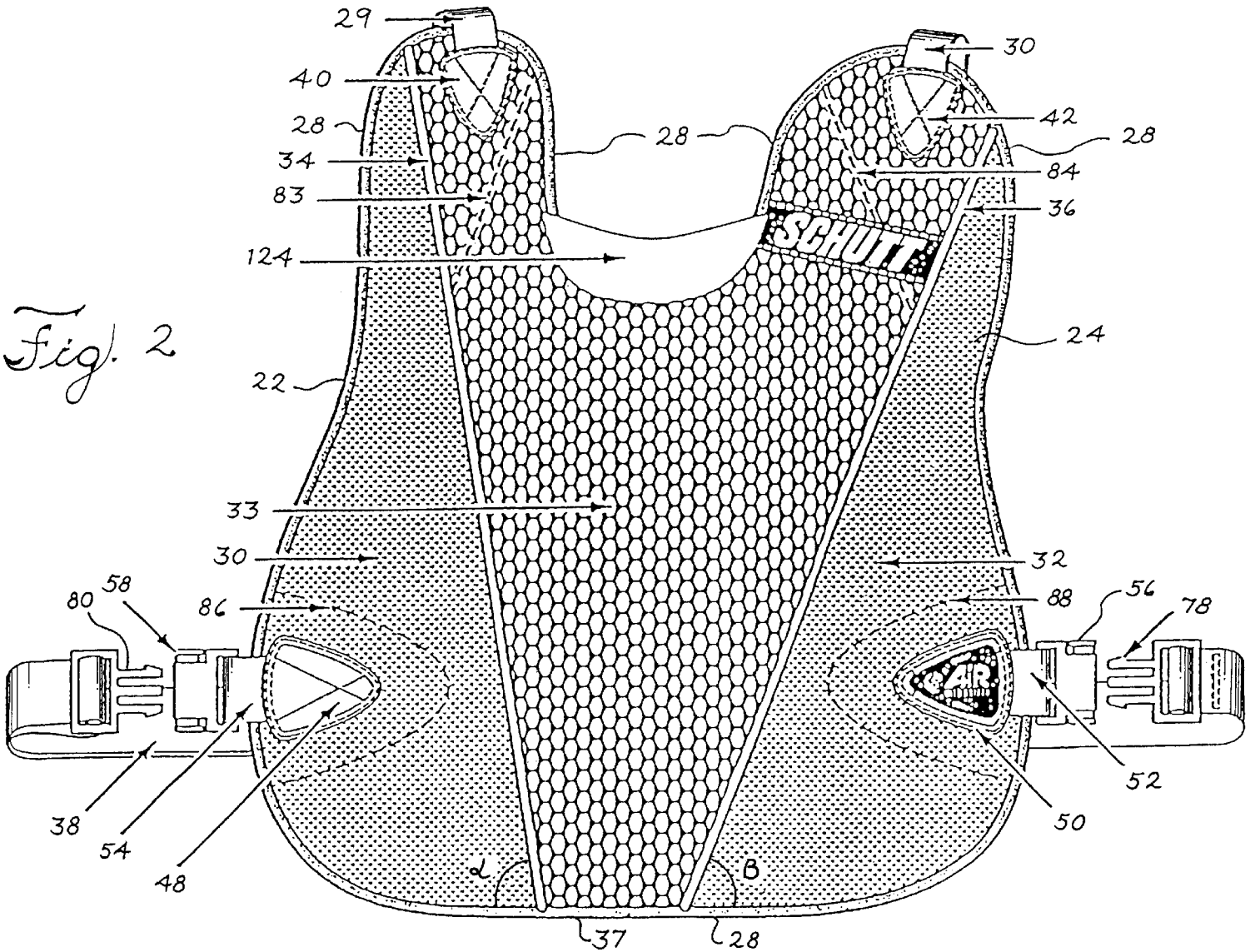
FIG. 2 shows a front view of an embodiment of a pouch assembly to be used with the chest protector of FIG. 1.
Figure 3:
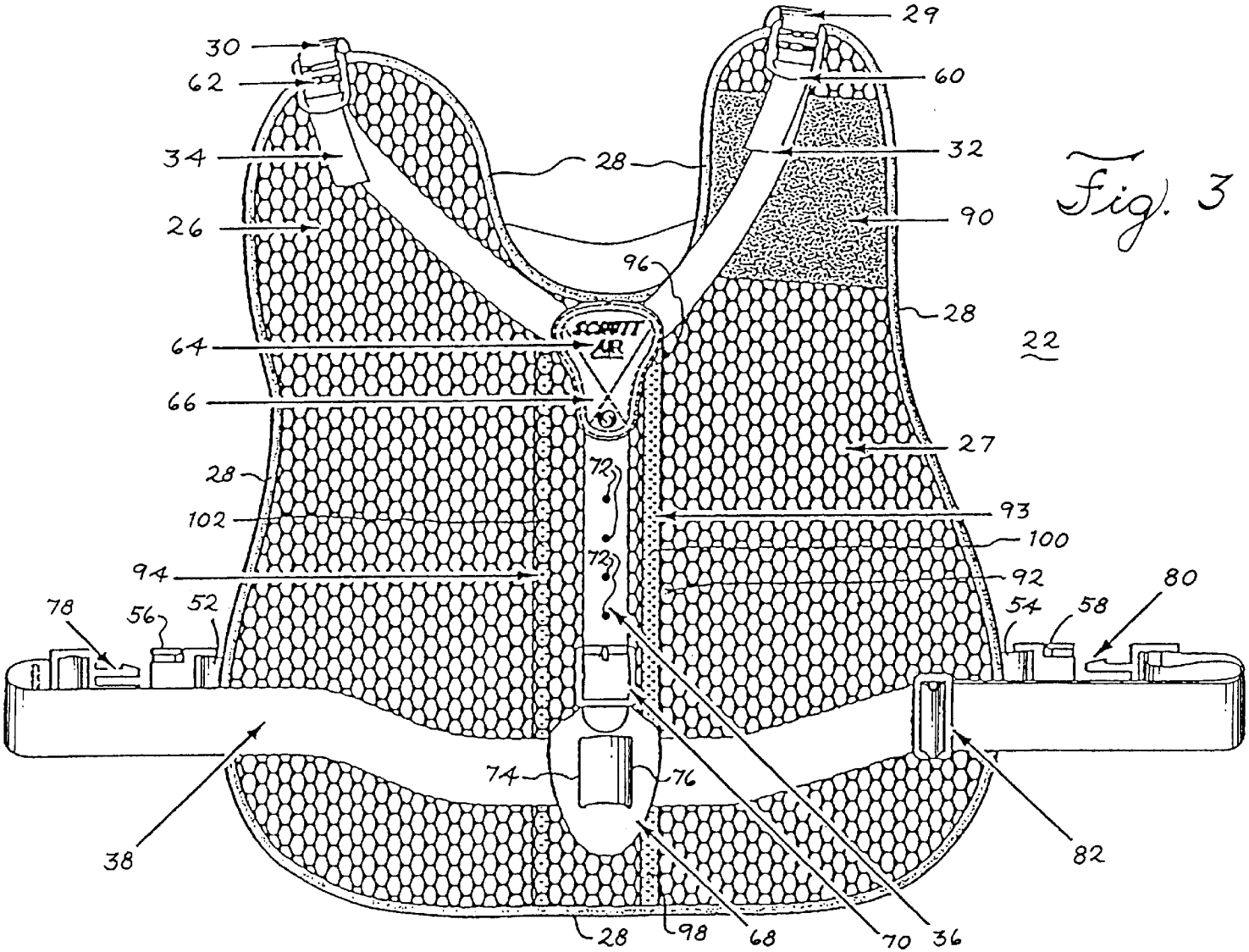
FIG. 3 shows a rear view of the pouch assembly of FIG. 2.

Referring flow to the drawings wherein like reference characters designate identical or corresponding parts throughout the several figures, and in particular FIGS. 1–7 show a chest protector 20 that is designed to be worn on a person's chest. As shown in FIGS. 1–3, the chest protector 20 is composed of a pouch assembly 22 that is primarily made of a front sheet 24 that is attached to a pair of overlapping rear sheets 26 and 27 by a seam 28 that is located at the exterior edge of the pouch assembly 22. The front sheet 24 is composed of a pair of outside panels 30 and 32 are sewn to a central panel 33 at the seam 28 and along slanted lines that are covered by pipings 34 and 36, respectively. The central panel 33 and the rear sheets 26 and 27 are preferably made of a porthole mesh material with circular openings that is typical for practice jerseys. The outside panels 30 and 32 are made of an athletic mesh material. The pipings 34 and 36 extend upward from the bottom portion 37 of the seam 28 at angles $\alpha$ and $\beta$ ranging from approximately 70° to 80° and 68° to 74°, respectively.

As shown in FIGS. 2 and 3, a pair of shoulder straps 29 and 30, a pair of upper straps 32 and 34, a center belt 36 and an elastic belt 38 are attached directly or indirectly to the pouch assembly 22. As shown in FIG. 2, a pair of leather shoulder patches 40 and 42 is sewn onto the upper shoulder portions of the front sheet 24. Each of the shoulder straps 29 and 30 is a one-inch wide elastic loop that is sewn to the shoulder patches 40 and 42, respectively. In addition, a pair of leather waist patches 48 and 50 are sewn onto the outside panels 30 and 32, respectively. Each of the patches 48 and 50 has a 1.5" wide elastic waist loop 52, 54. The loops 52 and 54 may each have a female receptor 56, 58 attached thereto. In an alternative embodiment, loop 52 has a female receptor 56 while loop 58 has a rectangular, plastic loop attached thereto.

As shown in FIG. 3, the upper straps 32 and 34 are attached to the shoulder straps 29 and 30, respectively, via 1" Ladderloc buckles 60 and 62, respectively. In an alternative embodiment, each upper strap is fed through a buckle, like buckles 60 and 62, fed through a rectangular ring attached to the corresponding shoulder strap and attached to the middle bar of the buckle. In either embodiment, the upper straps 32 and 34 are trapped between the upper portion 64 of a strap stay 66 and an identical lower portion of the strap stay (not shown) and sewn to both portions of the strap stay 66. The upper part of the center belt 36 is also trapped between and sewn to the upper and lower portions of the strap stay 66. The center belt 36 is also attached to a lower strap stay 68 made of leather that has a rivet loop, which contains a metal buckle 70. A desired length for the center belt 36 is achieved by having the metal buckle 70 engage one of the holes 72 formed in the center belt 36 that corresponds to the desired length. In an alternative embodiment, the center belt 36 is elastic and is passed through a buckle, like buckles 60 and 62, passed through a horizontal slot formed in the lower strap stay 68 and attached to the middle bar of the buckle.

As shown in FIG. 3, the lower strap stay 68 also includes two vertical slots 74 and 76 into which the elastic belt 38 is inserted. In the embodiment where a female receptors 56, 58 are attached to the loops 52 and 54, then each end of the elastic belt 38 has a male attachment member 78, 80 attached thereto via a half loop formed in the belt 38. The length of the elastic belt 38 can be varied via a buckle 82. In the alternative embodiment described previously where only a single female receptor 56 is attached to the belt 38, the length of the belt 38 can be varied via a buckle, like buckles 60 and 62. In this embodiment, the belt 38 is passed through the buckle and the rectangular, plastic loop and then attached to the middle bar of the buckle.

Besides including attachment straps, the pouch assembly 22 further includes several reinforcement features. For example, triangular-like shaped shoulder reinforcements 83 and 84 made of black nylon can be sewn to the underside of the upper shoulder portions of the front sheet 24. Similarly, triangular-like shaped waist reinforcements 86 and 88 made of black nylon can be sewn to the underside of the front sheet 24 at the edges of the waist. In addition, a loop material 90, such as that known under the trademark VELCRO, is sewn to the rear sheet 27 so as to be captured under the binding to allow the convenient attachment and positioning of a shoulder pad protection cap.

The pouch assembly 22 further defines an opening 92. As mentioned previously, rear sheets 26 and 27 overlap one another. As shown in FIG. 3, the right edge 93 of sheet 26 overlaps the left edge 94 of sheet 27 by approximately 2¼". The top and bottom portions 96 and 98 of the right edge 92 are then sewn onto the sheet 27. The portions 96 and 98 each have a length of approximately 2". The central portions 100 and 102 of the right edge 92 and left edge 94 are not sewn to the other sheet resulting in the formation of an opening 92. The central portions 100 and 102 have lengths of approximately 10".

Figure 4:
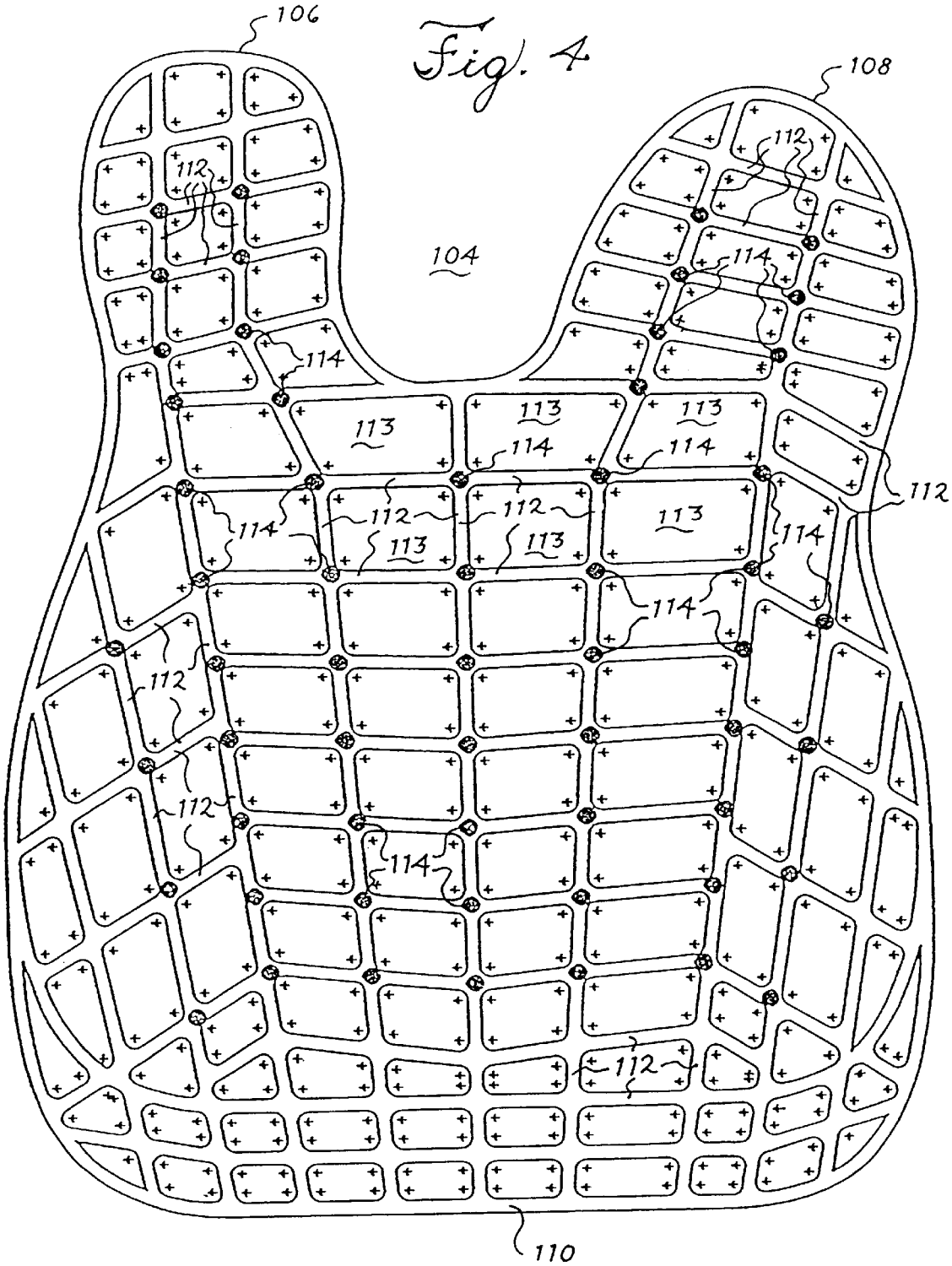
FIG. 4 shows a front view of an embodiment of a foam pad to be used with the chest protector of FIG. 1.

A 9/16" thick foam pad 104 is inserted into the opening 92 formed in the rear sheets 26 and 27 of the pouch assembly 22. As shown in FIG. 4, the foam pad 104 has a shape that matches that of the pouch assembly 22 of FIGS. 2 and 3. The foam pad 104 has a length of approximately 22" as measured from the top of the shoulder portions 106, 108 to the bottom edge 110 of the pad 104. The foam pad 104 has a maximum width of approximately 17". The foam pad 104 is made of cross-linked polyethylene and has a plurality of channels 112 formed on the front and rear surfaces of the pad 104 so that a plurality of pad islands 113 are formed. As shown in FIG. 4, the channels 112 on the front surface of the pad are either vertical, horizontal or slanted. Note that the planar surfaces of the channels 112 are formed along a plane that is a perpendicular bisector of the pad 104 along the width of the pad.

Note that a pattern of channels and pad islands are formed on the rear surface of the pad as well. The pattern of channels and pad islands on the rear surface are a mirror image of the channels 112 and pad islands 113 with respect to the plane that is a perpendicular bisector of the pad 104 along the width of the pad.

The channels 112 of the front surface and the channels on the rear surface each have a depth of approximately ¼" and a width of approximately ⅜". At a number of places where the channels 112 intersect one another, a circular opening 114 having a diameter of approximately ⅜" is formed that extends entirely through the pad 104 so that air can pass through the pad 104. A majority of the openings 114 are formed in the central area of the pad 104 as shown in FIG. 4.

In order to provide further protection to a player, a shoulder cap 116 can be attached to the pouch assembly 22. The shoulder cap 116 is preferably made of hard polypropylene cupped material 118. As shown in FIGS. 5–7, the material 118 is sewn to a hook material 120, such as that known under the trademark VELCRO, that is attached to a vinyl backing material 122. If it is desired to wear a shoulder cap 116, then the hook material 120 is placed so as to engage the loop material 90 attached to the rear sheet of the pouch assembly 22 as shown in FIG. 3. Note that a fabric laminated foam can be sewn over the cupped material 118 as shown in FIG. 1.

Prior to use, a clean pad 104 is preferably inserted into the interior of the pouch assembly 22. Insertion is accomplished by separating the central portions 100 and 102 from one another and inserting the pad 104 into the opening 92. The pad 104 is inserted so that the shoulder portions 106 and 108 are inserted into the portions of the interior of the pouch assembly 22 that correspond in shape to the shoulder portions of the pad 104.

Once the pad 104 is inserted into the pouch assembly 22, the chest protector 20 is worn by having the player insert his or her head between the upper straps 32 and 34 and having the upper straps 32 and 34 lie on the shoulders of the player. Next, the male attachment member(s) of the belt 38 are attached to their corresponding female members attached to the pouch assembly 22. The straps 32, 34, center belt 36 and belt 38 are adjusted in length so that a comfortable fit is achieved and so the foam collar 124 sewn to the central panel 33 is positioned below the catcher's mask so as to provide comfort to the neck of the catcher.

As the chest protector is worn, air is able to travel through the holes of the central panel 33, the holes of the pad 104 and the holes of the rear sheets 26 and 27 so as to reach the uniform of the player. This air aids in cooling the player and allows heat generated by the player to be expelled back through the holes of the rear sheets, the pad and the central panel.

If the player wearing the chest protector 20 is playing baseball or softball on a humid day, sweat can soak through the player's uniform and dampen the pouch assembly 22 and the pad 104. This causes the chest protector 20 to become heavier. The chest protector 20 becomes even heavier when dirt or dust is propelled onto the dampened pouch assembly and pad 104 causing the dirt to stick thereto. Situations where dirt or dust would be propelled onto the chest protector would be when a player slides into home plate or a ball thrown into the dirt is blocked by the chest protector. The weight of such a chest protector 20 is reduced by removing the pad 104 and inserting a fresh, clean and dry pad 104. The removed pad 104 is then washed by hand or hosed off with water causing the pad to be cleaned. After being cleaned, the pad 104 is dried so that it can be inserted into pouch assembly when a pad within the pouch assembly becomes dirty and/or moist.

The foregoing description is provided to illustrate the invention, and is not to be construed as a limitation. Numerous additions, substitutions and other changes can be made to the invention without departing from its scope as set forth in the appended claims.

We claim:

1. A chest protector comprising:

a pouch assembly having an interior in communication with an opening, said pouch assembly having a hole in fluid communication with said interior and ambient air;

a pad inserted into said interior, wherein said pad comprises an opening that is in fluid communication with said hole of said pouch assembly.

2. The chest protector of claim 1, wherein said pad comprises foam.

3. The chest protector of claim 1, wherein said pad substantially conforms to the shape of said pouch assembly.

4. The chest protector of claim 1, wherein said pad comprises a channel into which said hole is positioned.

5. The chest protector of claim 4, wherein said pad comprises a second channel, wherein said hole is positioned where said channel and said second channel intersect one another.

6. The chest protector of claim 1, wherein said pouch assembly comprises a first sheet and a second sheet that overlaps said first sheet, wherein said opening is formed at an area where said second sheet overlaps said first sheet.

7. The chest protector of claim 1, further comprising a shoulder strap attached to said pouch assembly.

8. The chest protector of claim 7, further comprising a belt that is attached to said shoulder strap.

9. The chest protector of claim 8, further comprising a strap attached to said belt and said shoulder strap, wherein said strap is substantially perpendicular to said belt.

10. A method of using a chest protector comprising:

inserting a pad into an interior of a pouch assembly;

having a person wear said pouch assembly and said inserted pad; and having ambient air freely flow through a first surface of said pouch assembly, through said pad, and contacting a surface of the person wearing said pouch assembly and said inserted pad.

11. The method of claim 10, wherein said having ambient air freely flow further comprises having said ambient air freely flow a second surface of said pouch assembly.

12. The method of claim 10, further comprising blocking a ball with said chest protector.

13. The method of claim 10, wherein said inserting comprises separating said second sheet from said first sheet so as to reveal an opening.

14. The method of claim 13, wherein said inserting comprises inserting said pad into said revealed opening.

15. The method of claim 10, further comprising removing said pad from said interior of said pouch assembly; and inserting a second pad into said interior of said pouch assembly.

16. The method of claim 15, cleaning said pad removed from said interior of said pouch assembly.

17. The method of claim 15, further comprising having a person wearing said pouch assembly and said inserted second pad; and having ambient air freely flow through a first surface of said pouch assembly, through said second pad, and contacting a surface of the person wearing said pouch assembly and said inserted second pad.

18. A method of using a chest protector comprising:

inserting a pad into an interior of a pouch assembly;

having a person wear said pouch assembly and said inserted pad during the playing of baseball or softball; and removing said pad from said interior of said pouch assembly.

19. The method of claim 18, further comprising inserting a second pad into said interior of said pouch assembly after said removing said pad.

20. The method of claim 19, further comprising having a person wearing said pouch assembly and said inserted second pad.

21. The method of claim 18, further comprising blocking a ball with said chest protector.

22. The method of claim 18, cleaning said pad removed from said interior of said pouch assembly.

* * * * *